US005294030A

United States Patent [19]

Jollivette

[11] Patent Number: 5,294,030

[45] Date of Patent: Mar. 15, 1994

[54] WAIST SUPPORTED CARRYING BAG

[76] Inventor: Earl E. Jollivette, 3520 W. 83rd St., Inglewood, Calif. 90305

[21] Appl. No.: 929,028

[22] Filed: Aug. 13, 1992

[51] Int. Cl.[5] ..... A45F 3/00

[52] U.S. Cl. ..... 224/226; 224/216; 224/228; 224/223; 224/253; 224/255; 224/901; 2/DIG. 1; 383/38

[58] Field of Search ..... 224/201, 202, 204, 205, 224/208-216, 223-228, 235-237, 240, 253, 255, 257-264, 901; 383/38-40; 2/94, 211, 312, 319, DIG. 1

[56] References Cited

U.S. PATENT DOCUMENTS

| | | | |
|---|---|---|---|
| 1,141,941 | 6/1915 | Danz, II | 224/215 |
| 1,175,584 | 3/1916 | Batchelder | 224/227 |
| 1,334,582 | 3/1920 | Archibald | 224/214 X |
| 1,385,224 | 7/1921 | Orr | 224/236 X |
| 1,850,920 | 3/1932 | Calkins | 383/38 |
| 2,475,914 | 7/1949 | Peterson | 224/204 |
| 4,923,105 | 5/1990 | Snyder | 224/255 |
| 4,957,231 | 9/1990 | Kalisher | 224/240 X |
| 5,131,576 | 5/1992 | Turnispeed | 224/262 |
| 5,205,448 | 4/1993 | Kester et al. | 224/253 X |

FOREIGN PATENT DOCUMENTS

| | | | |
|---|---|---|---|
| 0729549 | 7/1932 | France | 224/215 |
| 0377958 | 1/1940 | Italy | 224/228 |
| 0011370 | of 1908 | United Kingdom | 224/227 |

*Primary Examiner*—J. Casimer Jacyna
*Attorney, Agent, or Firm*—Albert O. Cota

[57] ABSTRACT

A carrying bag for mail or other heavy objects which has a pair of open topped compartments (20) upon which a number of pockets (36) are attached. A flap (38) covers each open top and a back connecting girdle (42) joins the compartment together. A quantity of belt loops (40) are connected to the compartments as well as the back connecting girdle and a belt (46) penetrates the loops thus placing the compartments one on each side of the hips of the carrier distributing the weight evenly. A front coupler (54) is attached permanently on one side to a compartment and is detachable from the other compartment on the opposite side completely encompassing the carrier around the waist. Optionally suspenders (56), shoulder straps (58) or a weight bearing vest (60) is attached to the belt for sharing the weight with the wearer's shoulders.

3 Claims, 3 Drawing Sheets

WAIST SUPPORTED CARRYING BAG

TECHNICAL FIELD

The present invention relates to carrying bags that are supported around a user's waist, more specifically to a carrying bag with compartments and pockets having a waist encircling belt to distribute the weight evenly around the user's hips.

BACKGROUND ART

Previously, many types of carrying bags have been used in endeavoring to provide an effective means for carrying mail and other heavy objects that are supported from the waist. At the present time, the United States Postal Service uses a shoulder satchel as the primary bag for transporting mail by carriers. This type of bag is supported on only one shoulder with a narrow strap. Other types of pouches and carrying accessories that encircle the wearer's waist have been developed in the past, including a mail bag structure with a single open top container that was recently introduced in an attempt to solve the specific problem of mail carriers.

A search of the prior art did not disclose any patents that read directly on the claims of the instant invention, however the following U.S. patents are considered related:

| U.S. PAT. NO. | INVENTOR | ISSUED |
|---|---|---|
| 4,988,024 | Weber | 29 January 1991 |
| 4,974,761 | Luque | 4 December 1990 |
| 4,884,732 | Sunderland | 5 December 1989 |
| 4,836,428 | Evans, et al | 6 June 1989 |
| 4,303,187 | Berman | 1 December 1981 |

Weber in U.S. Pat. No. 4,988,024 teaches a collection wire basket that has a bottom mesh structure permitting sand and other debris to fall through retaining articles larger than the openings. A bottom deflector plate protects the user and a solid panel next to the user's body prevents direct contact with the contents. The basket may be fastened around the waist using a flexible tube and an attachment clip.

U.S. Pat. No. 4,974,761 of Luque discloses a slot machine coin bag holding a container that may be adapted to be worn on one's waist with a buckled strap.

A game bag for a scuba diver is presented in Sunderland's U.S. Pat. No. 4,884,732 which includes a flexible tubular envelope with an open mouth and closed end. The mouth is attached to the diver's belt at both the front and rear with the envelope disposed between the driver's legs.

U.S. Pat. No. 4,836,428 issued to Evans, et al employs a bag of heavy material such as canvas with an open top and a sleeve or sleeves to receive a belt worn around the carrier's waist. The bag may be positioned on either side of the body and has sufficient strength to carry mail. Another embodiment has a double row of belt loops allowing the belt to be positioned in one or the other rows to adjust the height of the bag relative to the carrier's waist.

Berman in U.S. Pat. No. 4,303,187 provides a number of pockets on a base panel that contains a pair of belt loops through which a belt is placed and is buckled to the wearer's trousers. The lower portion of the panel includes a tie string encircling the wearer's thigh. The pockets store personal objects for the wearer.

The search revealed bags suited for specific purposes and with the exception of Evans et al disclosure, the structure renders them unsuitable for carrying mail and heavy objects around the waist. While Evans et al do attempt to solve the problem, a single open bag is disclosed attached to a wide belt. The problem of weight distribution and multiple pockets for sorted mail is still left unsolved by prior art.

DISCLOSURE OF THE INVENTION

There has been a great need for some time to carry heavy loads such as mail in a comfortable and evenly weight distributed manner. As previously mentioned, mail carriers historically use single strap satchels that place all of the weight on a single shoulder potentially causing neck, back and shoulder injuries along with being awkward in use. It is therefore a primary object of the invention to provide a waist encircling bag that provides two separate compartments with pockets, one on each side of the carrier which equally balances the weight permitting the carrying of as much as three times the weight as a conventional satchel without discomfort and fatique.

An important object of the invention is the fact that the waist supported bag is ergomically compatible with the function of a mail carrier, in that letters, literature and other articles are easily accessible on either side of the carrier's body permitting visual identification on both sides as well as increased mobility while walking. Further, equal balance is achieved and mail may be inserted into the compartments and pockets such that the removal in presorted sequence may be achieved from both sides reducing the weight equally as material is removed.

Another object of the invention is the comfort and support of the bag with its cushioned waist belt and optional shoulder straps. As the support of the weight is now transferred to the waist and hips, the upper body is free to move, opening gates and mailboxes without loosing balance and still maintaining complete mobility. In other embodiments straps, suspenders and a weight supporting vest help to transfer some of the weight to the shoulders which permits full use of the carriers complete body to distribute the weight and provide added comfort.

Still another object of the invention enhances productivity of the mail carrier as more mail could be delivered in a shorter time due to less fatique, accessibility to the mail and freedom of movement.

Yet, another object of the invention is directed to the protective nylon flaps that cover the open top of the compartments and pockets. These flaps shield the contents of the bag from the environmental elements such as rain, snow, dust etc. while easily moved out of the way for access. Further, these flaps help to secure the contents from falling out when a carrier leans forward or stoops down.

A further object of the invention is the ability of the invention to be used for other applications than mail. Its size and configuration lends its utility for carrying newspapers, express mail, small parcels and envelops, delivery service matter or even parcels and goods by a shopper or tourist.

These and other objects and advantages of the present invention will become apparent from the subsequent detailed description of the preferred embodiment and the appended claims taken in conjunction with the accompanying drawings.

Figure 1:
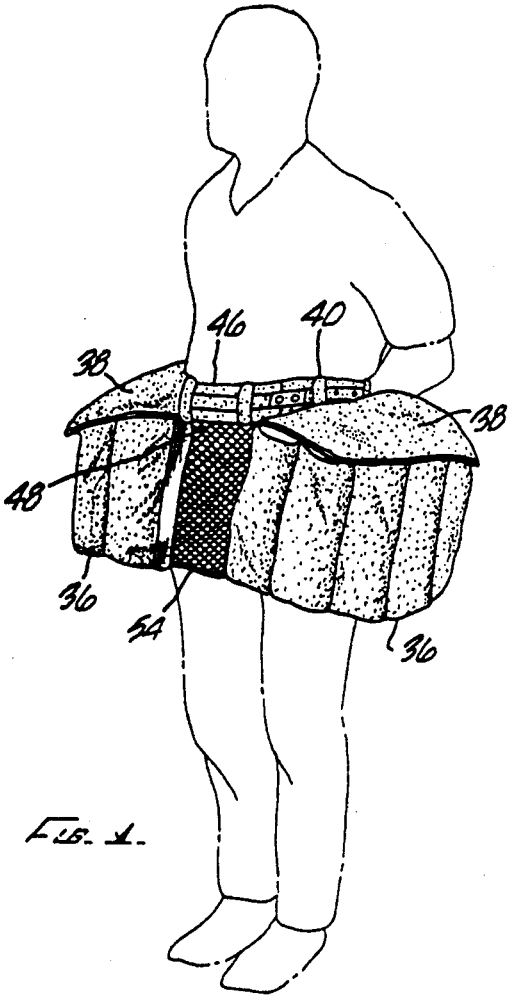
FIG. 1 is a front view of the invention worn around a person's waist.

In views 1, 2, 6, 7 and 8, the person wearing the bag is shown in phantom.

BEST MODE FOR CARRYING OUT THE INVENTION

The best mode for carrying out the invention is presented in terms of a preferred embodiment. This preferred embodiment is shown in FIGS. 1 through 5 and is comprised of a pair of opposed open topped compartments 20 each having a back 22, front 24, and sides 26. Each compartment 20 further has a strap 28 over the top in the middle from front to back holding the compartment together when it is filled with mail or other articles.

The strap 28 is attached to the back 22 of the compartment 20 on one end and the other end contains hook and loop tape 30 alternatively one after the other along the bottom surface. A closed rectangular loop 32 made of metal or thermoplastic is attached to the front 24 of the compartment with a connecting strip 34. This arrangement allows the strap 28 to be inserted into the loop 32 and folded back over the loop and pressed into the opposed hook and loop tape 30 creating a removable fastener. The strap 28 is preferably formed of a band of flexible fibre webbing however, any suitable material may be substituted. The hook and loop tape 30, better known by its registered trademark "VELCRO" and the loop 32 may be equally substituted by a myriad of other fasteners each well known in the art without deviating from the scope of the invention.

A number of open topped pockets 36 are attached by sewing, bonding, riveting etc. to the compartments on both the front 24 and sides 26. These pockets 36 are preferably, at least the width and height of a stack of letters, permitting a mail carrier to easily remove presorted stacks individually from each pocket or the actual number required. The size of the pockets 36 in other embodiments used for normally carrying articles other than mail may vary to suit the application. In any event, the combined compartments 20 and pockets 36 are preferably made of a synthetic fibre material stitched together with thread such as nylon, rayon, polyester, etc. or made from an organic fabric such as canvas or the like. Further, the material may also be leather or a man made substitute thereof.

Figure 2:
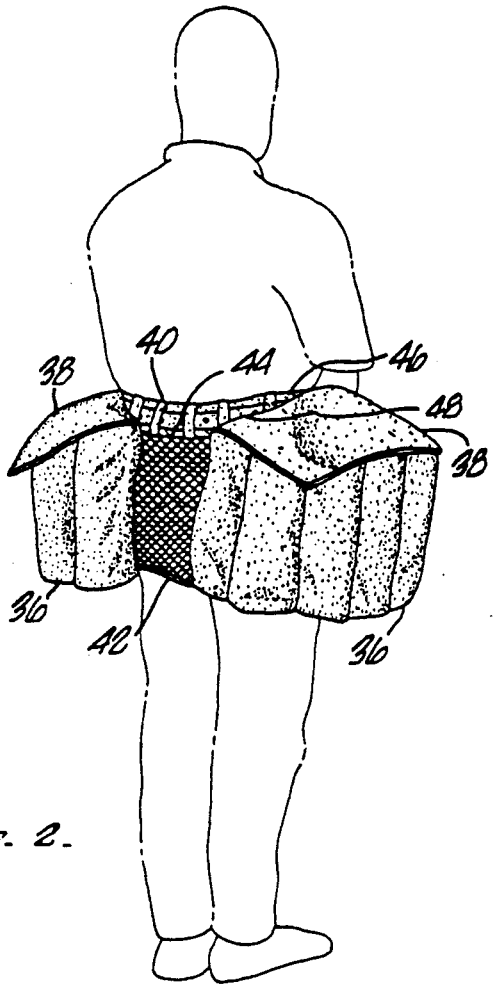
FIG. 2 is a near view of the invention worn around a person's waist.
Figure 3:
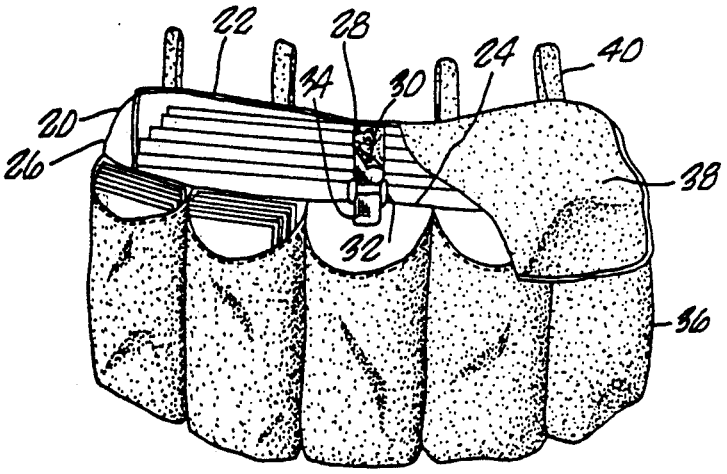
FIG. 3 is an upper view of one of the individual compartments and pocket assemblies completely removed from the rest of the invention for clarity. This view also cuts away a portion of the flap to illustrate the interior.

The combined compartment 20 and outwardly extending pockets 36 are optionally covered with a flap 38 attached to the rear of each compartment covering both of the open tops thereby protecting the contents of the bag from the weather or accidental spills. The flap 38 may be attached on the front edge and the pockets 36 with fastening means well known in the art or it may be configured to slip over the top. Alternately, the flap 38 may be rigid enough to hold its shape as it simply lays on top of the bag as illustrated in FIGS. 1-3. As an option or in another embodiment shown in FIG. 4, the flap 38 may include a strip of hook tape 30 on the inside edge and the pockets and a strip of loop tape 30 in the appropriate location creating an easily detachable closure. The material of the flap 38 may be the same as the compartment 20 and pockets 36 however, nylon is preferred.

Each compartment 20 further contains a series of belt loops 40 along the upper back 22 edge, adjacent to the flap 38 interface. These belt loops 40 are strong enough to support the weight of the loaded bag. The distance the loops 40 are positioned from the flap interface may vary as to the physical make up of the user to achieve optimum fit and comfort.

A back connecting girdle 42 joins the compartments 20 together at the interface of the back 22 and sides 26 by sewing or the like. The girdle 42 has a top 44, sides and a back with belt loops 40 attached to the top 44 similar to those previously described. The girdle 42 may be of any material suitable for the application including the same natural or synthetic fibre as the compartments 20 and pockets 36 however, nylon mesh is preferred, due to its ability to breath thereby permitting air to easily penetrate the material.

A belt 46 is threaded into the above described loops 40 and encompasses the carrier's waist transmitting and distributing the weight of the bag and its contents evenly around the waist of the carrier which is capable of supporting considerable weight with ease and without discomfort. The belt 46 may include a resilient pad 48 conforming to the wearer's waist adding to the comfort of the wearer when carrying heavy loads. This pad 48 is made of a resilient material such as open or closed cell foam covered with a sewn fabric or may be felt or any other substance suitable for the application.

Figure 5:
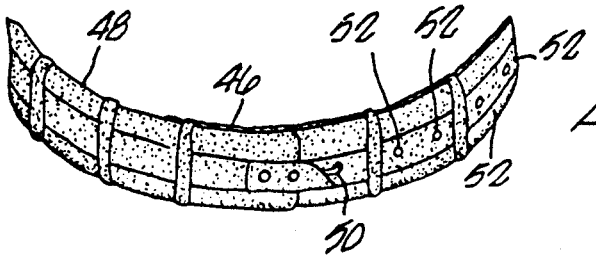
FIG. 5 is a fragmenting view of the front of the belt completely removed from the invention for clarity.

The belt 46 is attached in the front of the carrier with buckling means in any of the well known forms however, a hook 50 and a number of eyes 52 or grommets are preferred as illustrated in FIG. 5. This arrangement provides length adjustment by positioning the hook 50 in the appropriate eye 52.

A detachable front coupler 54 is permanently connected on one side to one of the compartment sides 26 and removably attached on the other side to the opposed compartment side 26 forming a circumferential structure around the complete waist of the carrier. The bag assembly now completely encircles the user therefore distributing the weight evenly over the entire contiguous body surface. The removable connection is preferably made using hook and loop tape 30, as previously described, with the arrangement illustrated best in FIG. 4 folded back. The tape 30 or so called VELCRO is easily adjusted to an exact fit and may be removed and reattached numerous times without wear or distortion.

Figure 6:
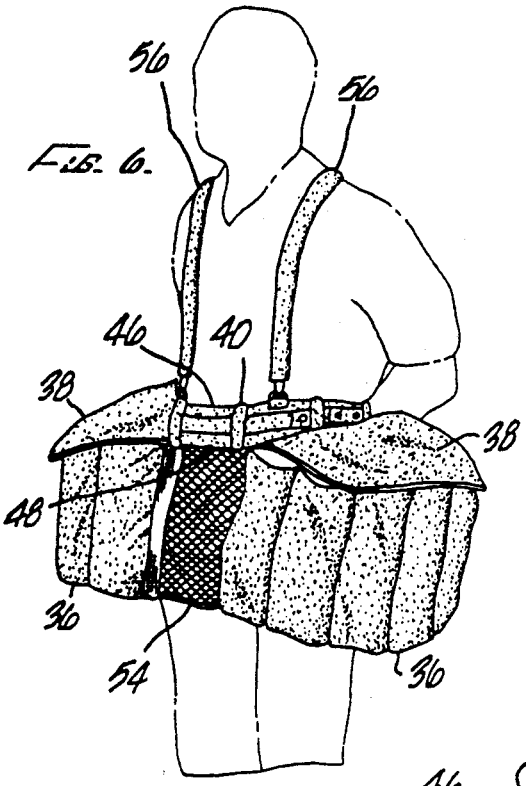
FIG. 6 is a front view of the invention with suspenders attached to the belt.
Figure 7:
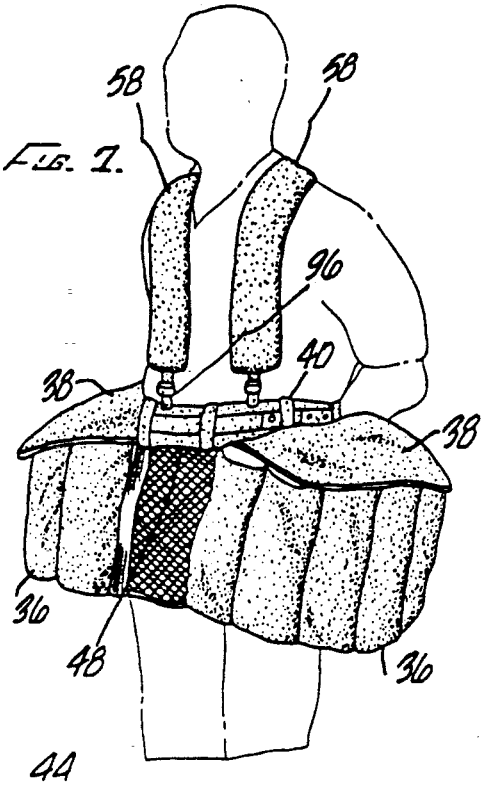
FIG. 7 is a front view of the invention with shoulders straps attached to the belt.
Figure 4:
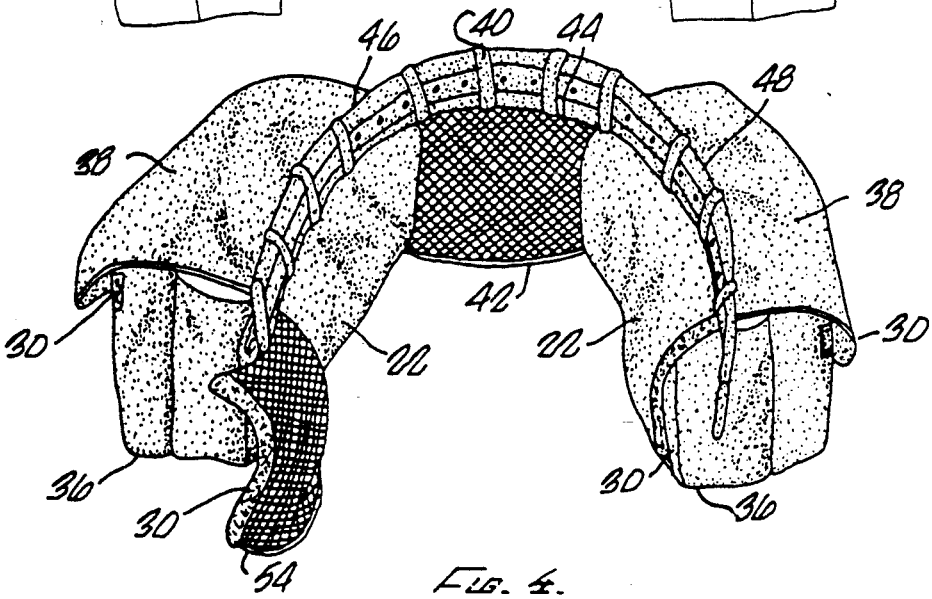
FIG. 4 is a partial isometric view of the invention looking from above and in front with the belt unhooked and placed in an open position as well as the front coupler folded back for viewing.
Figure 8:
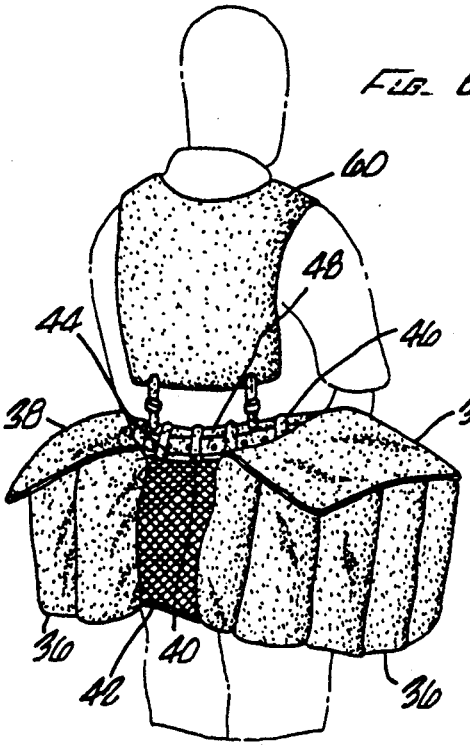
FIG. 8 is a rear view of the invention with a vest attached to the belt.
Figure 9:
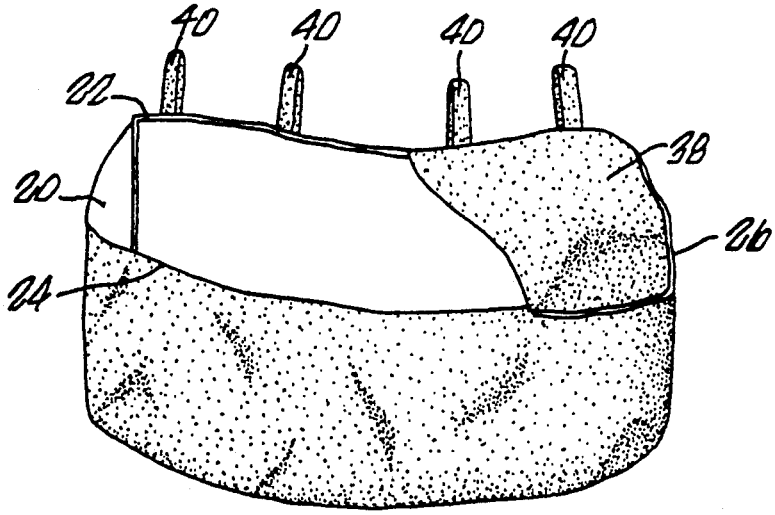
FIG. 9 is an upper view of one of the individual compartments that does not include pocket assemblies and shown completely removed from the rest of the invention. This view also cuts away a portion of the flap to illustrate the interior.

In another embodiment illustration in FIG. 6, a pair of suspenders 56 are attached to the belt 46 are are positioned over the carrier's shoulders helping to distribute some of the weight to the shoulder area as well as the hips. FIG. 7 shows yet another embodiment functioning the same except with wider and padded shoulder straps 58. Still another embodiment depicted in FIG. 8 employs a weight bearing vest 60 again for the same purpose.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

I claim:

1. A waist encircling carrying bag for mail and other heavy matter comprising:

a) a pair of opposed open topped compartments having a back, a front, a bottom and a pair of sides also a strap attachment traversing the open top from front to back to hold the front and back together when the compartment is full where said strap, further comprises a band of flexible fibre webbing attached on a first end to the back of each compartment and a second end having linearly adjacent hook tape and loop tape, further, a structural loop attached to the front of each compartment with a connecting strip permitting the band of webbing to be inserted into the loop and pulled back over the loop with the hooks intermeshing with the loops on the tape creating an adjustable union therebetween, b) a plurality of open topped pockets fixably joined to the front and sides of each compartment for carrying a stack of mail that has been pre-sorted, c) a flap attached to the rear of each compartment covering both the open tops of the combined compartment and pockets for protecting contents stored within the carrying bag from adverse environmental conditions and accidental spilling, d) a plurality of belt loops fixably joined to the back of each compartment adjacent to the flap interface for carrying weight therewith, e) a back connecting girdle having a top, a bottom and a pair of sides with the sides permanently joined to each compartment where the sides and backs interface, further said girdle top having a plurality of belt loops affixed thereupon for supporting weight, f) a belt having buckling means threadably inserted into the belt loops of the compartments and girdle for attachment to a wearer's waist for transmitting weight from mail and other heavy matter carried within the compartments and pockets to a supportive portion of a carrier, and g) a detachable front coupler having a first side and a second side, with the first side permanently connected to one of the compartment sides and the second end removably attached to the remaining compartment side permitting the entire bag to encircle a carrier for evenly distributing weight of mail and other heavy matter over a comfortable area of a carrier's body.

2. A waist encircling carrying bag for mail and other heavy matter comprising:

a) a pair of opposed open topped compartments having a back, a front, a bottom and a pair of sides also a strap attachment traversing the open top from front to back to hold the front and back together when the compartment is full, b) a plurality of open topped pockets fixably joined to the front and sides of each compartment for carrying a stack of mail that has been pre-sorted.

c) a flap attached to the rear of each compartment covering both the open tops of the combined compartment and pockets for protecting contents stored within the carrying bag from adverse environmental conditions and accidental spilling, d) a plurality of belt loops fixably joined to the back of each compartment adjacent to the flap interface for carrying weight therewith, e) a back connecting girdle is formed of a nylon mesh permitting air to penetrate therethrough, said girdle having a top, a bottom and a pair of sides with the sides permanently joined to each compartment where the sides and backs interface, further said girdle top having a plurality of belt loops affixed thereupon for supporting weight, f) a belt having buckling means threadably inserted into the belt loops of the compartments and girdle for attachment to a wearer's waist for transmitting weight from mail and other heavy matter carried within the compartments and pockets to a supportive portion of a carrier, and g) a detachable front coupler having a first side and a second side, with the first side permanently connected to one of the compartment sides and the second end removably attached to the remaining compartment side permitting the entire bag to encircle a carrier for evenly distributing weight of mail and other heavy matter over a comfortable area of a carrier's body.

3. A waist encircling carrying bag for mail and other heavy matter comprising:

a) a pair of opposed open topped compartments having a back, a front, a bottom and a pair of sides also a strap attachment traversing the open top from front to back to hold the front and back together when the compartment is full, b) a plurality of open topped pockets fixably joined to the front and sides of each compartment for carrying a stack of mail that has been pre-sorted.

c) a flap attached to the rear of each compartment covering both the open tops of the combined compartment and pockets for protecting contents stored within the carrying bag from adverse environmental conditions and accidental spilling, d) a plurality of belt loops fixably joined to the back of each compartment adjacent to the flap interface for carrying weight therewith, e) a back connecting girdle having a top, a bottom and a pair of sides with the sides permanently joined to each compartment where the sides and backs interface, further said girdle top having a plurality of belt loops affixed thereupon for supporting weight, f) a belt having buckling means threadably inserted into the belt loops of the compartments and girdle for attachment to a wearer's waist for transmitting weight from mail and other heavy matter carried within the compartments and pockets to a supportive portion of a carrier, and g) a detachable front coupler having a first side and a second side, with the first side permanently connected to one of the compartment sides and the second end removably attached to the remaining compartment side permitting the entire bag to encircle a carrier for evenly distributing weight of mail and other heavy matter over a comfortable area of a carrier's body where said coupler further comprises hook and loop tape disposed upon the second side of the coupler and on the end of one of the compartment permitting removal and reattachment thereof.

* * * * *